US011415066B1

(12) United States Patent
Urushihara et al.

(10) Patent No.: US 11,415,066 B1
(45) Date of Patent: Aug. 16, 2022

(54) INTERNAL COMBUSTION ENGINE

(71) Applicant: Mazda Motor Corporation, Hiroshima (JP)

(72) Inventors: Tomonori Urushihara, Aki-gun (JP); Masanari Sueoka, Aki-gun (JP); Yusuke Kawai, Aki-gun (JP); Atsushi Inoue, Aki-gun (JP); Masatoshi Hidaka, Aki-gun (JP); Kota Matsumoto, Aki-gun (JP); Tota Tanii, Aki-gun (JP); Michiharu Kawano, Aki-gun (JP); Toru Miyamoto, Aki-gun (JP); Tsubasa Ito, Aki-gun (JP)

(73) Assignee: Mazda Motor Corporation, Hiroshima (JP)

( * ) Notice: Subject to any disclaimer, the term of this patent is extended or adjusted under 35 U.S.C. 154(b) by 0 days.

(21) Appl. No.: 17/457,307

(22) Filed: Dec. 2, 2021

(30) Foreign Application Priority Data

Feb. 15, 2021 (JP) ..... JP2021-021774

(51) Int. Cl.
*F02D 13/02* (2006.01)
*F02D 41/30* (2006.01)
(Continued)

(52) U.S. Cl.
CPC ..... *F02D 13/0211* (2013.01); *F02B 75/18* (2013.01); *F02D 41/0077* (2013.01);
(Continued)

(58) Field of Classification Search
CPC ..... F02B 75/18; F02B 2075/1824; F02D 41/0077; F02D 41/30; F02M 26/22; F02P 5/15
See application file for complete search history.

(56) References Cited

U.S. PATENT DOCUMENTS 6,860,252 B1 * 3/2005 Ganoung ..... F02B 31/085 123/308
11,346,295 B2 * 5/2022 Van Nieuwstadt ... F02D 41/025
(Continued)

FOREIGN PATENT DOCUMENTS

WO 2018096745 A1 5/2018

*Primary Examiner* — Carl C Staubach
(74) *Attorney, Agent, or Firm* — Alleman Hall Creasman & Tuttle LLP

(57) ABSTRACT

An internal combustion engine is provided, which includes a variable phase mechanism configured to change rotational phases of intake and exhaust camshafts so that a valve overlap is made. An intake cam lobe is formed such that an open period of the intake valve is 210° or larger and 330° or smaller of a crank angle. The exhaust cam lobe is formed such that, during the overlap period with the rotational phase of the intake camshaft advanced to the maximum and the rotational phase of the exhaust camshaft retarded to the maximum, an effective valve lift amount (Lift(CA)) of the exhaust valve which is a function of a crank angle from the open timing ($CA_{IVO}$) of the intake valve to a middle timing ($CA_{center}$) of the overlap period, an inner circumferential length (L_ex) of a valve seat, and a swept volume (V) per cylinder satisfy the following formula:

$$0.015 \leq \frac{L_ex}{V} \times \int_{CA_{IVO}}^{CA_{center}} \mathrm{Lift}(CA)\,dCA.$$

20 Claims, 9 Drawing Sheets

(51) Int. Cl.

| | |
|---|---|
| ***F02P 5/15*** | (2006.01) |
| ***F02M 26/22*** | (2016.01) |
| ***F02D 41/00*** | (2006.01) |
| ***F02B 75/18*** | (2006.01) |

(52) U.S. Cl.
CPC ..... *F02D 41/30* (2013.01); *F02M 26/22* (2016.02); *F02P 5/15* (2013.01); *F02B 2075/1824* (2013.01)

(56) References Cited

U.S. PATENT DOCUMENTS

| | | | | |
|---|---|---|---|---|
| 2003/0164163 | A1* | 9/2003 | Lei | F02M 26/01 60/602 |
| 2018/0094616 | A1* | 4/2018 | Takazawa | F02P 5/152 |
| 2019/0085772 | A1* | 3/2019 | Sueoka | F02D 41/0002 |
| 2019/0112989 | A1* | 4/2019 | Inoue | F02D 41/04 |
| 2021/0388788 | A1* | 12/2021 | Min | F02D 41/1401 |

* cited by examiner

INTERNAL COMBUSTION ENGINE

TECHNICAL FIELD

The present disclosure relates to an internal combustion engine which introduces burnt gas into a cylinder during an overlap period.

BACKGROUND OF THE DISCLOSURE

Studies for achieving both of improving fuel efficiency and driving performance are conducted on a daily basis in the development of internal combustion engines for automobiles.

For example, WO2018/096745A1 discloses a technology of a so-called SPCCI (SPark Controlled Compression Ignition) combustion in which a mixture gas inside a combustion chamber is ignited and combusted by flame propagation (Spark Ignition (SI) combustion), and then, unburnt mixture gas is combusted by compression self-ignition (Compression Ignition (CI) combustion). In this technology of the SPCCI combustion, a ratio of fresh air to burnt gas inside the combustion chamber, an injection timing and an injection amount of fuel, and an ignition timing are precisely controlled so as to adjust the ratio of the SI combustion to the CI combustion, and control the ignition timing in the CI combustion to improve thermal efficiency.

In order to further enhance the fuel efficiency, it is useful to improve the thermal efficiency by recirculating exhaust gas recirculation (EGR) gas (burnt gas combusted in a combustion chamber) into a cylinder to increase a heat capacity ratio. The EGR is roughly divided into external EGR which is recirculated into an intake passage from an exhaust passage via a heat exchanger, and internal EGR which is recirculated into the cylinder by providing a valve overlap period during which both of an exhaust valve and an intake valve open.

In WO2018/096745A1, the ratio of the internal EGR to the external EGR is changed according to the load. In detail, only internal EGR is recirculated when the load is low, and as the load becomes higher, the amount of internal EGR is reduced and the amount of external EGR is increased. When the load is further higher, boosting is performed by a mechanical supercharger so as to introduce both of external EGR gas and fresh air which are demanded.

However, since the mechanical supercharger is driven by utilizing motive power of the internal combustion engine, and uses a part of energy which is used by the internal combustion engine for driving a vehicle, the fuel efficiency tends to degrade due to the operation of the mechanical supercharger. Therefore, it is desirable to increase the heat capacity ratio by the internal EGR which can be introduced without the mechanical supercharger.

In order to introduce a large amount of internal EGR gas, it can be considered to increase the valve overlap period during which both of the exhaust valve and the intake valve open, or to lower the pressure in an intake passage so as to actively blow back the burnt gas from an independent exhaust passage to an independent intake passage.

When the demanded amount of fresh air is small, the required amounts of fresh air and internal EGR gas can be secured by increasing the overlap period. However, when the demanded amount of fresh air is increased for achieving driving performance, a throttle valve is required to be opened. When the throttle valve is opened, the intake passage pressure increases, and thus, the required amount of internal EGR cannot be secured. It is required to achieve lift characteristics of the intake valve and the exhaust valve which can introduce both of the internal EGR gas and fresh air while the intake passage pressure is high.

SUMMARY OF THE DISCLOSURE

The present disclosure is made in view of the above situations, and one purpose thereof is to provide an internal combustion engine, capable of introducing internal exhaust gas recirculation (EGR) gas and fresh air to achieve the driving performance, while actively introducing the internal EGR gas to improve the fuel efficiency.

As a result of diligent study to secure amounts of both of intake EGR and intake air, the present inventors found that there are optimal design values for lift characteristics of an intake valve and an exhaust valve.

According to one aspect of the present disclosure, an internal combustion engine is provided with a plurality of cylinders, an intake valve and an exhaust valve provided to each of the cylinders, an independent intake passage communicating at a downstream end thereof with each of the cylinders through the respective intake valve, and an independent exhaust passage communicating at an upstream end thereof with each of the cylinders through the respective exhaust valve.

The engine includes an intake camshaft including intake cam lobes configured to reciprocatably move the intake valves to have a given lift characteristic, respectively, and mechanically connected to the intake valves, an exhaust camshaft including exhaust cam lobes configured to reciprocatably move the exhaust valves to have a given lift characteristic, respectively, and mechanically connected to the exhaust valves, and a variable phase mechanism configured to change rotational phases of the intake camshaft and the exhaust camshaft with respect to a crankshaft, respectively, so that a valve overlap during which both of the intake valve and the exhaust valve of the same cylinder are open is made. The intake cam lobes are formed such that an open period of each intake valve from an open timing to a close timing is 210° or larger and 330° or smaller of a crank angle. The exhaust cam lobes are formed such that, during the overlap period when the variable phase mechanism advances the rotational phase of the intake camshaft to the maximum, and retards the rotational phase of the exhaust camshaft to the maximum, an amount of effective valve lift (Lift(CA)) of the exhaust valve, an inner circumferential length (L_ex) of a valve seat that contacts the exhaust valve when the exhaust valve is closed, and a swept volume (V) per cylinder satisfy the following Formula 1, the amount of effective valve lift being a function of a crank angle from the open timing ($CA_{IVO}$) of the intake valve to a middle timing ($CA_{center}$) of the overlap period.

$$0.015 \leq \frac{L_ex}{V} \times \int_{CA_{IVO}}^{CA_{center}} \mathrm{Lift}(CA)\,dCA \tag{1}$$

During an exhaust stroke with the exhaust valve opened, when the intake valve opens, burnt gas in the independent exhaust passage blows back to the independent intake passage due to a differential pressure between the pressure in the independent exhaust passage and the pressure in the independent intake passage. The burnt gas blown back to the independent intake passage is sucked into the cylinder as a result of the descending of a piston during an intake stroke, and becomes internal EGR.

Therefore, the overlap period where the intake valve opens with the rotational phase advanced to the maximum by the variable phase mechanism, and the exhaust valve opens with the rotational phase retarded to the maximum, becomes the maximum overlap period. During the maximum overlap period, a parameter S representing a lift characteristic can be substituted as the amount of the burnt gas blown back from the independent exhaust passage to the independent intake passage per unit swept volume. The parameter S is calculated with the following Formula 2 based on the amount of effective valve lift (Lift(CA)) of the exhaust valve which is a function of a crank angle from the open timing ($CA_{IVO}$) of the intake valve to a middle timing ($CA_{center}$) of the overlap period, the inner circumferential length (L_ex) of the valve seat that contacts the exhaust valve when the exhaust valve is closed, and the swept volume (V) per cylinder.

$$S = \frac{\text{L_ex}}{V} \times \int_{CA_{IVO}}^{CA_{center}} \text{Lift}(CA)dCA \quad (2)$$

According to examination by the present inventors, by setting the lift characteristic of the exhaust valve such that the parameter S is at or above 0.015, a sufficient amount of internal EGR can be secured.

In addition, by setting the open period of each intake valve to be a long period at 210° or larger and 330° or smaller, a large amount of fresh air can also be taken into the cylinder while securing the internal EGR per unit swept volume, since the intake valve closes at a timing when the piston rises from a bottom dead center.

The engine may further include an injector configured to inject fuel into each of the cylinders, a spark plug configured to ignite a mixture gas containing fuel, air, and EGR gas inside each of the cylinders, and a controller electrically connected to the injector and the spark plug, and configured to control the injector and the spark plug by sending an electric signal. The controller may control the injector and the spark plug so that, at least within part of an operation range of the engine, the mixture gas is ignited to start flame propagation combustion, and then unburned mixture gas is compressed to self-ignite.

This combustion is a so-called SPCCI (SPark Controlled Compression Ignition) combustion, and by introducing a large amount of internal EGR gas, the combustion speed of the compression self-ignition combustion in the SPCCI combustion is accelerated, which improves the fuel efficiency. Introducing both of the internal EGR and fresh air into the combustion chamber in large quantities, achieves both of improving the fuel efficiency and the driving performance.

A compression ratio of a combustion chamber comprised of a crown surface of a piston accommodated in the cylinder and a lower surface of a cylinder head, may be above 14.0:1.

By setting the combustion ratio of the combustion chamber in the range above 14.0:1, the SPCCI combustion can be performed in wide operation ranges.

The engine may be a naturally aspirated engine.

Since a mechanical supercharger is driven by utilizing part of a drive force generated by the combustion of the internal combustion engine, the fuel efficiency tends to degrade due to the operation of the supercharger. In this regard, the naturally aspirated engine can suppress the degradation of the fuel efficiency since the driving of the supercharger is unnecessary. Moreover, the internal combustion engine with this configuration can introduce both of the internal EGR and fresh air into the combustion chamber in large quantities, without using the supercharger.

The engine may be a six-cylinder engine with a total displacement at 2.9 L or larger, and may be disposed longitudinally in a vehicle.

With the six-cylinder engine with the total displacement at or larger than 2.9 L, the fuel efficiency is improved by performing the SPCCI combustion using the internal EGR, and since combustion is carried out three times per rotation of the crankshaft, higher output is possible compared with a four-cylinder engine.

The engine may further include a water-cooled type EGR cooler and an EGR valve disposed in an EGR passage. The controller may control the EGR valve to adjust a flow rate of exhaust gas passing thought the EGR passage. When the engine operates at a given fixed speed, an amount of internal EGR gas may be increased as a load of the engine increases from low to middle, and the amount of internal EGR gas may be reduced while an amount of external EGR gas is increased when the load is middle, the given fixed speed being a low-speed range or a middle-speed range when the speed of the engine is divided equally into three ranges including the low-speed range, the middle-speed range, and a high-speed range.

DETAILED DESCRIPTION OF THE DISCLOSURE

Hereinafter, one embodiment of an internal combustion engine is described with reference to the accompanying drawings. The internal combustion engine described herein is merely illustration.

Figure 1:
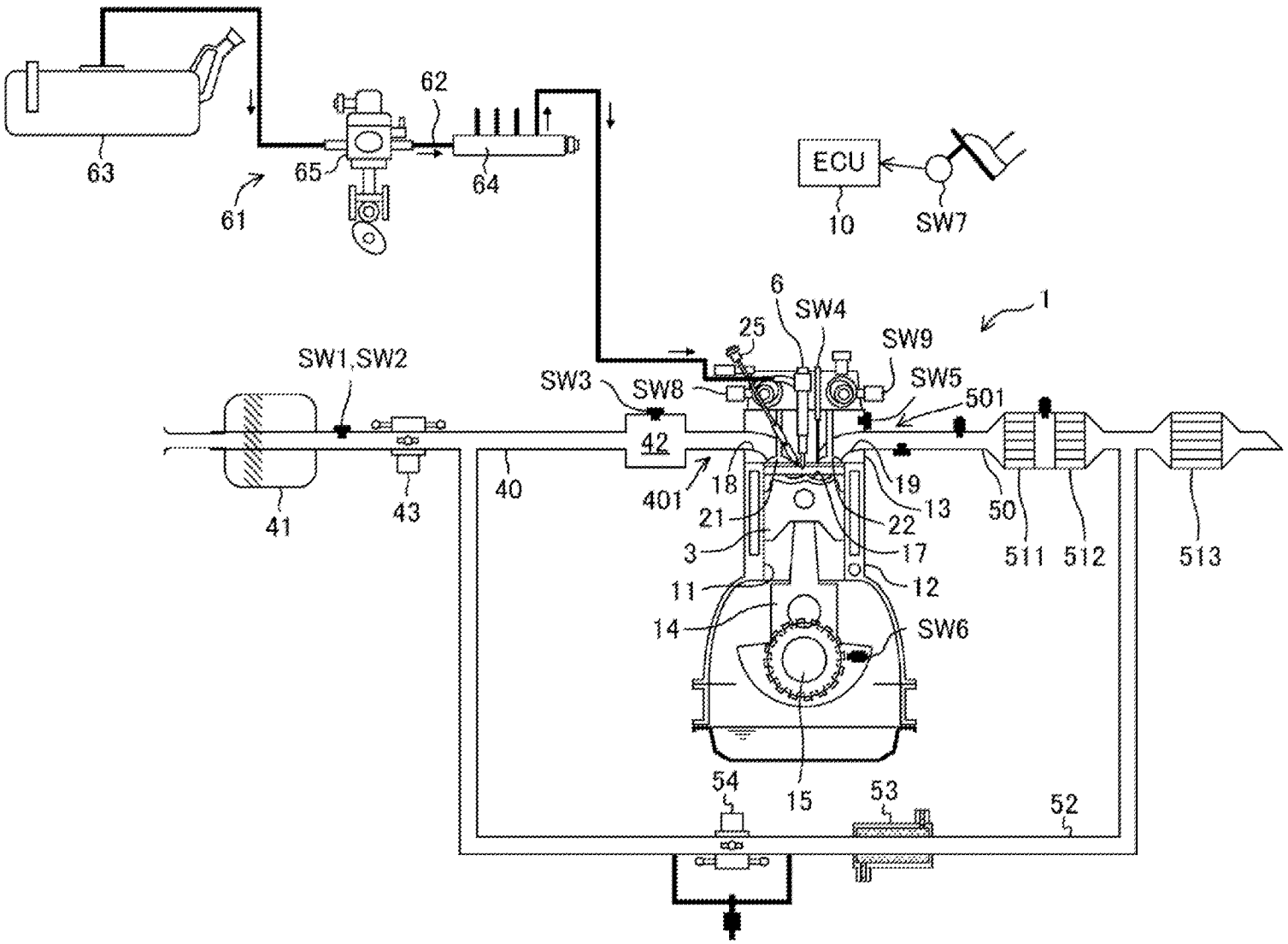
FIG. 1 is a view illustrating an internal combustion engine.
Figure 2:
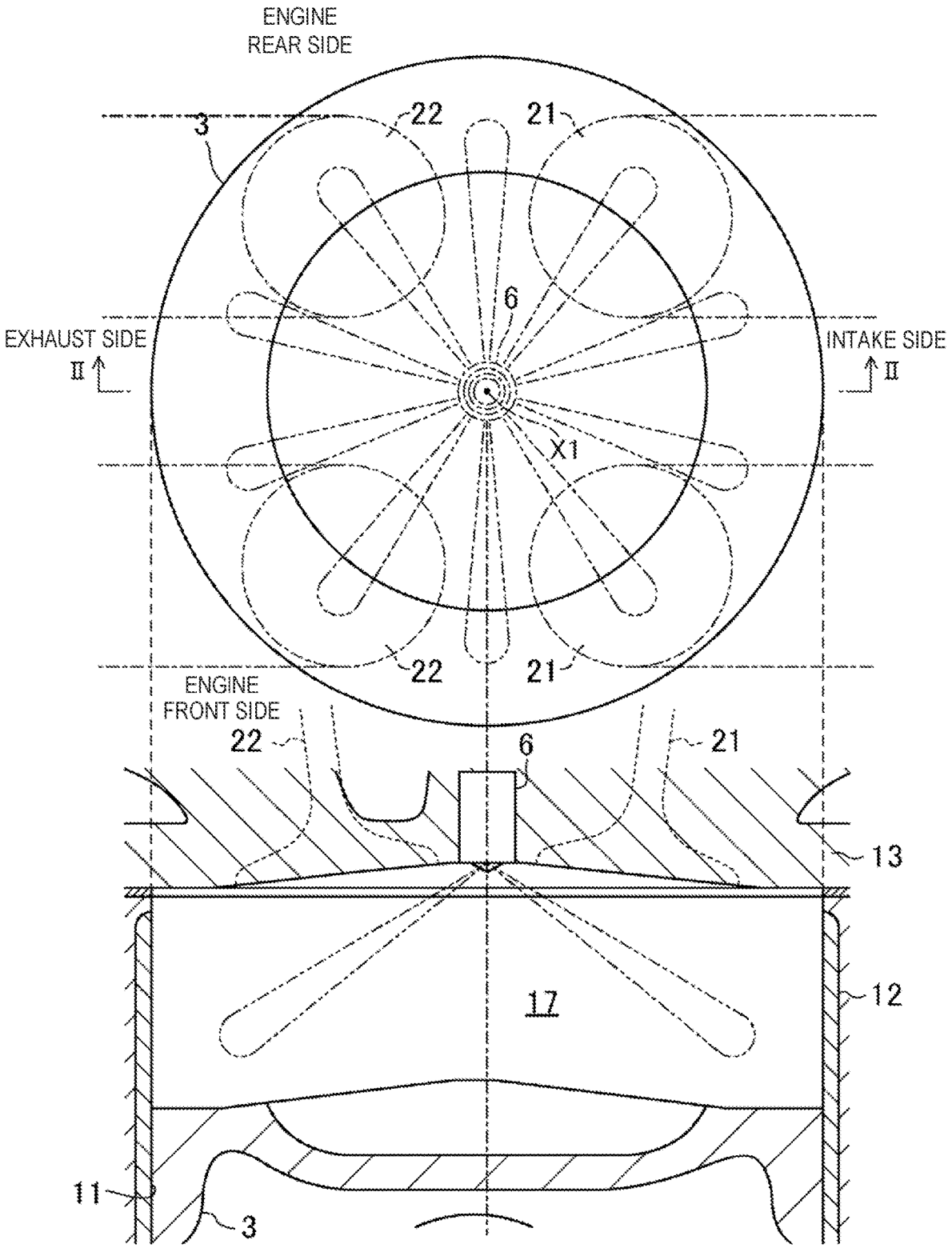
FIG. 2 is a view illustrating a structure of a combustion chamber of the internal combustion engine, where an upper part of this figure is a plan view, and a lower part is a cross-sectional view taken along a line II-II in the upper part.
Figure 3:
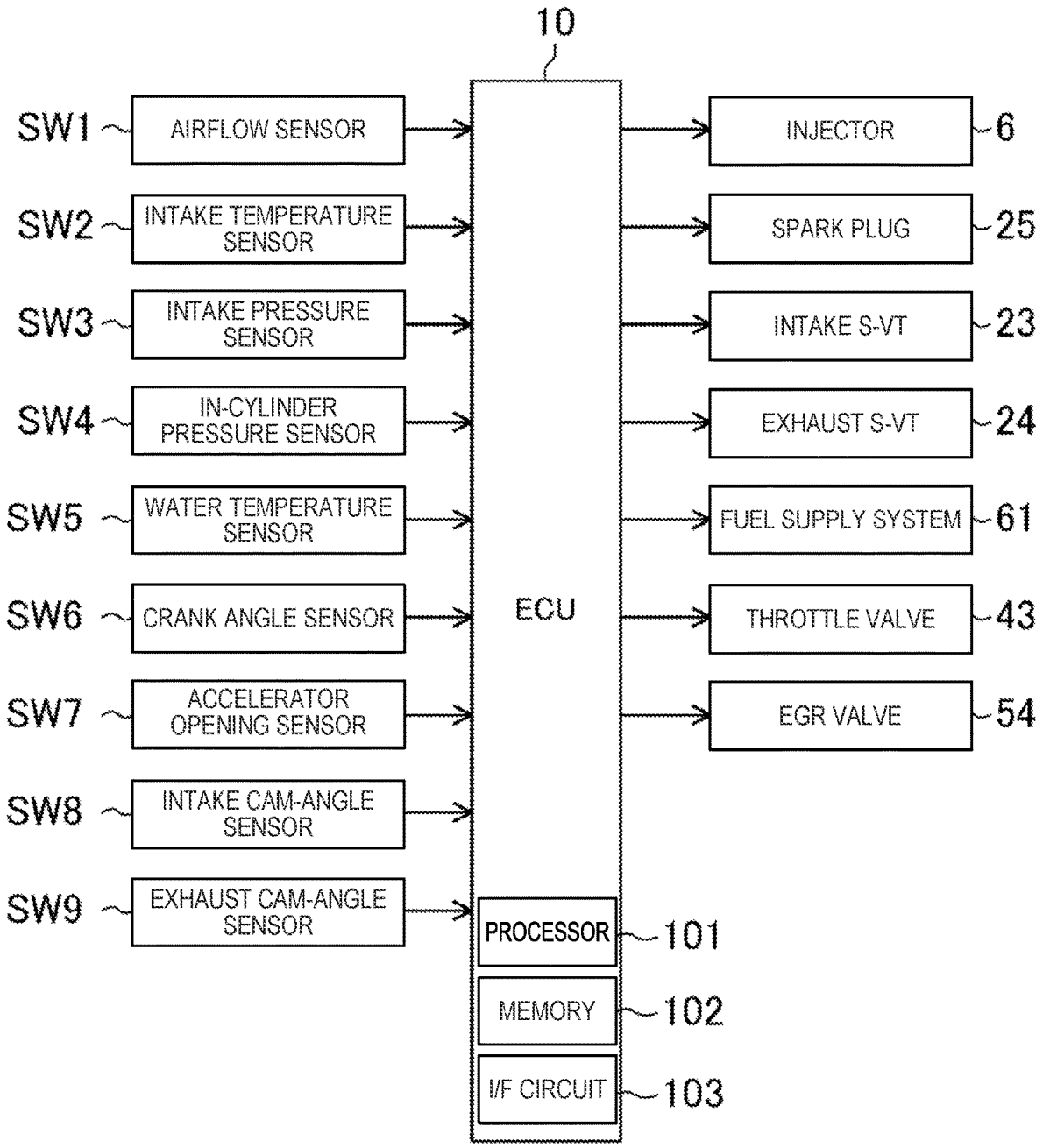
FIG. 3 is a block diagram of the internal combustion engine.

FIG. 1 is a view illustrating an internal combustion engine 1. FIG. 2 is a view illustrating a structure of a combustion chamber of the internal combustion engine 1. The intake side and the exhaust side illustrated in FIG. 1 are opposite to the intake side and the exhaust side illustrated in FIG. 2. FIG. 3 is a block diagram illustrating a configuration related to a control of the internal combustion engine 1.

The internal combustion engine 1 includes cylinders 11, and is a four-stroke engine in which an intake stroke, a compression stroke, an expansion stroke, and an exhaust stroke are repeated in each cylinder 11. The internal combustion engine 1 is mounted on a four-wheeled automobile, and the automobile travels according to the operation of the internal combustion engine 1. Fuel of the internal combustion engine 1 is gasoline in this example.

(Configuration of Internal Combustion Engine)

The internal combustion engine 1 (hereinafter, referred to as "the engine 1") is provided with a cylinder block 12 and a cylinder head 13. A plurality of cylinders 11 are formed in the cylinder block 12. Although the engine 1 is a multi-cylinder engine, only one cylinder 11 is illustrated in FIG. 1.

For example, the engine 1 is a straight-six engine, and its total displacement is 2.9 liters or larger. The engine 1 is disposed inside an engine room as a so-called longitudinal engine (a crankshaft is oriented along the longitudinal axis of a vehicle). The six-cylinder engine with the total displacement at or larger than 2.9 L can improve the fuel efficiency by performing SPCCI (SPark Controlled Compression Ignition) combustion (described later) using internal exhaust gas recirculation (EGR) gas, and higher output is possible compared with a four-cylinder engine since combustion is carried out three times per rotation of the crankshaft. Note that the technology disclosed herein is not limited to be applied to the straight-six engine having the displacement at or larger than 2.9 L.

Pistons 3 are inserted into the respective cylinders 11. Each piston 3 is coupled to a crankshaft 15 via a connecting rod 14. An upper surface (crown surface) of the piston 3, the cylinder 11, and a lower surface of the cylinder head 13 define a combustion chamber 17.

A geometric compression ratio of the engine 1 is set to be high aiming at improvement in theoretical thermal efficiency, and stabilization of the SPCCI combustion (described later). In detail, a geometric compression ratio c of the engine 1 is at or above 14.0:1. When the geometric compression ratio $\varepsilon$ of the engine 1 is below 14.0:1 ($14.0:1<\varepsilon$), the engine 1 can achieve the SPCCI combustion over a wide operation range. The geometric compression ratio may be 18:1, for example, and may suitably be set within a range at or above 14:1 and at or below 20:1.

The cylinder head 13 is formed with intake ports 18 for the respective cylinders 11. Each intake port 18 communicates with inside of the cylinder 11.

Each intake port 18 is provided with an intake valve 21. The intake valve 21 is a poppet valve, and opens and closes the intake port 18. A valve mechanism including an intake camshaft is mechanically connected to the intake valve 21, and opens and closes the intake valve 21 at given timings. The valve mechanism may be a variable valve mechanism which can change a valve timing and/or a valve lift. As illustrated in FIG. 3, the valve mechanism includes an intake S-VT (Sequential-Valve Timing) 23. The intake S-VT 23 sequentially changes a rotational phase of the intake camshaft with respect to the crankshaft 15 within a given angular range. An open period of the intake valve 21 is not changed. The intake S-VT 23 is a variable phase mechanism of an electric type or a hydraulic type.

The cylinder head 13 is formed with exhaust ports 19 for the respective cylinders 11. Each exhaust port 19 communicates with inside of the cylinder 11.

Each exhaust port 19 is provided with an exhaust valve 22. The exhaust valve 22 is a poppet valve, and opens and closes the exhaust port 19. A valve mechanism including an exhaust camshaft is mechanically connected to the exhaust valve 22, and opens and closes the exhaust valve 22 at given timings. The valve mechanism may be a variable valve mechanism which can change a valve timing and/or a valve lift. As illustrated in FIG. 3, the valve mechanism includes an exhaust S-VT 24. The exhaust S-VT 24 sequentially changes a rotational phase of the exhaust camshaft with respect to the crankshaft 15 within a given angular range. An open period of the exhaust valve 22 is not changed. The exhaust S-VT 24 is a variable phase mechanism of an electric type or a hydraulic type.

Injectors 6 are attached to the cylinder head 13 for the respective cylinders 11. As illustrated in FIG. 2, each injector 6 is disposed at the central part of the cylinder 11 in the plan view. The injector 6 directly injects fuel into the cylinder 11. Although not illustrated in detail, the injector 6 is a multiple nozzle hole type having a plurality of nozzle holes. As indicated by two-dot chain lines in FIG. 2, the injector 6 injects fuel to spread radially from the central part to the peripheral part of the cylinder 11.

The injector 6 is connected with a fuel supply system 61. The fuel supply system 61 is comprised of a fuel tank 63 which stores fuel, and a fuel supply passage 62 which couples the fuel tank 63 to the injector 6. A fuel pump 65 and a common rail 64 are interposed in the fuel supply passage 62. The fuel pump 65 pumps fuel to the common rail 64. The common rail 64 stores at a high fuel pressure the fuel pumped from the fuel pump 65. When the injector 6 is valve-opened, the fuel stored in the common rail 64 is injected into the cylinder 11 from the nozzle holes of the injector 6. Note that the configuration of the fuel supply system 61 is not limited to the configuration described above.

Spark plugs 25 are attached to the cylinder head 13 for the respective cylinders 11. Each spark plug 25 forcibly ignites a mixture gas inside the cylinder 11.

The engine 1 is connected at one side surface with an intake passage 40. The intake passage 40 communicates with the intake ports 18 of the cylinders 11. Air to be introduced into the cylinders 11 flows through the intake passage 40. The intake passage 40 is provided at its upstream-end part with an air cleaner 41. The air cleaner 41 filters the air. The intake passage 40 is provided, near its downstream end, with a surge tank 42. A part of the intake passage 40 downstream of the surge tank 42 constitutes independent intake passages 401 branching for the respective cylinders 11 (see FIG. 1). Downstream ends of the independent intake passages 401 are connected to the intake ports 18 of the cylinders 11, respectively. The engine 1, which is the six-cylinder engine, includes six independent intake passages 401.

The intake passage 40 is provided, between the air cleaner 41 and the surge tank 42, with a throttle valve 43. The throttle valve 43 adjusts its opening to control an amount of air to be introduced into the cylinder 11.

The engine 1 is a naturally aspirated engine without a supercharger or a turbocharger. For example, when compared with an internal combustion engine 1 provided with a mechanical supercharger which performs boosting by utilizing motive force of the internal combustion engine 1, the naturally aspirated engine does not require driving of the supercharger, thus reducing degradation in the fuel efficiency.

The engine 1 is connected at the other side surface with an exhaust passage 50. The exhaust passage 50 communicates with the exhaust ports 19 of the cylinders 11. The exhaust passage 50 is a passage through which exhaust gas discharged from the cylinders 11 flows. Although not illustrated in detail, an upstream part of the exhaust passage 50 constitutes independent exhaust passages 501 branching for the respective cylinders 11 (see FIG. 1). Upstream ends of the independent exhaust passages 501 are connected to the exhaust ports 19 of the cylinders 11, respectively. The engine 1, which is the six-cylinder engine, includes six independent exhaust passages 501.

The exhaust passage 50 is provided with an exhaust gas purification system having a plurality of catalytic converters. An upstream catalytic converter includes, for example, a three-way catalyst 511 and a GPF (Gasoline Particulate Filter) 512. A downstream catalytic converter includes a three-way catalyst 513. Note that the exhaust gas purification system is not limited to the illustrated configuration. For example, the GPF may be omitted. Moreover, the catalytic converter is not limited to the one including the three-way catalyst. Further, the disposed order of the three-way catalyst and the GPF may be changed suitably.

An EGR passage 52 is connected between the intake passage 40 and the exhaust passage 50. The EGR passage 52 is a passage through which a part of exhaust gas recirculates to the intake passage 40. An upstream end of the EGR passage 52 is connected to part of the exhaust passage 50 between the upstream and downstream catalytic converters. A downstream end of the EGR passage 52 is connected to part of the intake passage 40 between the throttle valve 43 and the surge tank 42.

The EGR passage 52 is provided with an EGR cooler 53 of a water-cooled type. The EGR cooler 53 cools exhaust gas. The EGR passage 52 is also provided with an EGR valve 54 which adjusts a flow rate of exhaust gas flowing through the EGR passage 52. The EGR valve 54 changes its opening to adjust a recirculating amount of external EGR gas.

As illustrated in FIG. 3, a control device for the engine 1 is provided with an ECU (engine control unit) 10 to operate the engine 1. The ECU 10 is a controller based on a well-known microcomputer, and includes a processor (e.g., a CPU (Central Processing Unit)) 101 which executes a program, memory 102 which is comprised of, for example, RAM (Random Access Memory) and/or ROM (Read Only Memory), and stores the program and data, and an interface (I/F) circuit 103 which outputs and inputs an electric signal. The ECU 10 is one example of a "controller."

As illustrated in FIGS. 1 and 3, various kinds of sensors SW1-SW9 are connected to the ECU 10. The sensors SW1-SW9 output signals to the ECU 10. The sensors include the following sensors. An airflow sensor SW1 is provided to the intake passage 40 downstream of the air cleaner 41, and measures the flow rate of air flowing through the intake passage 40. An intake temperature sensor SW2 is provided to the intake passage 40 downstream of the air cleaner 41, and measures the temperature of the air flowing through the intake passage 40. An intake pressure sensor SW3 is attached to the surge tank 42, and measures the pressure of the air to be introduced into the cylinder 11. An in-cylinder pressure sensor SW4 is attached to the cylinder head 13 for each cylinder 11, and measures the pressure inside the cylinder 11. A water temperature sensor SW5 is attached to the engine 1, and measures the temperature of coolant. A crank angle sensor SW6 is attached to the engine 1, and measures a rotational angle of the crankshaft 15. An accelerator opening sensor SW7 is attached to an accelerator pedal mechanism, and measures an accelerator opening corresponding to an operation amount of an accelerator pedal. An intake cam-angle sensor SW8 is attached to the engine 1, and measures a rotational angle of the intake camshaft. An exhaust cam-angle sensor SW9 is attached to the engine 1, and measures a rotational angle of the exhaust camshaft.

The ECU 10 determines the operating state of the engine 1 based on the signals of the sensors SW1-SW9, and also calculates a control amount of each device based on a control logic set in advance. The control logic is stored in the memory 102. The control logic includes calculating a target amount and/or the control amount by using a map stored in the memory 102.

The ECU 10 outputs electric signals related to the calculated control amounts to the injector 6, the spark plug 25, the intake S-VT 23, the exhaust S-VT 24, the fuel supply system 61, the throttle valve 43, and the EGR valve 54.

(Control of Internal Combustion Engine)

Figure 4:
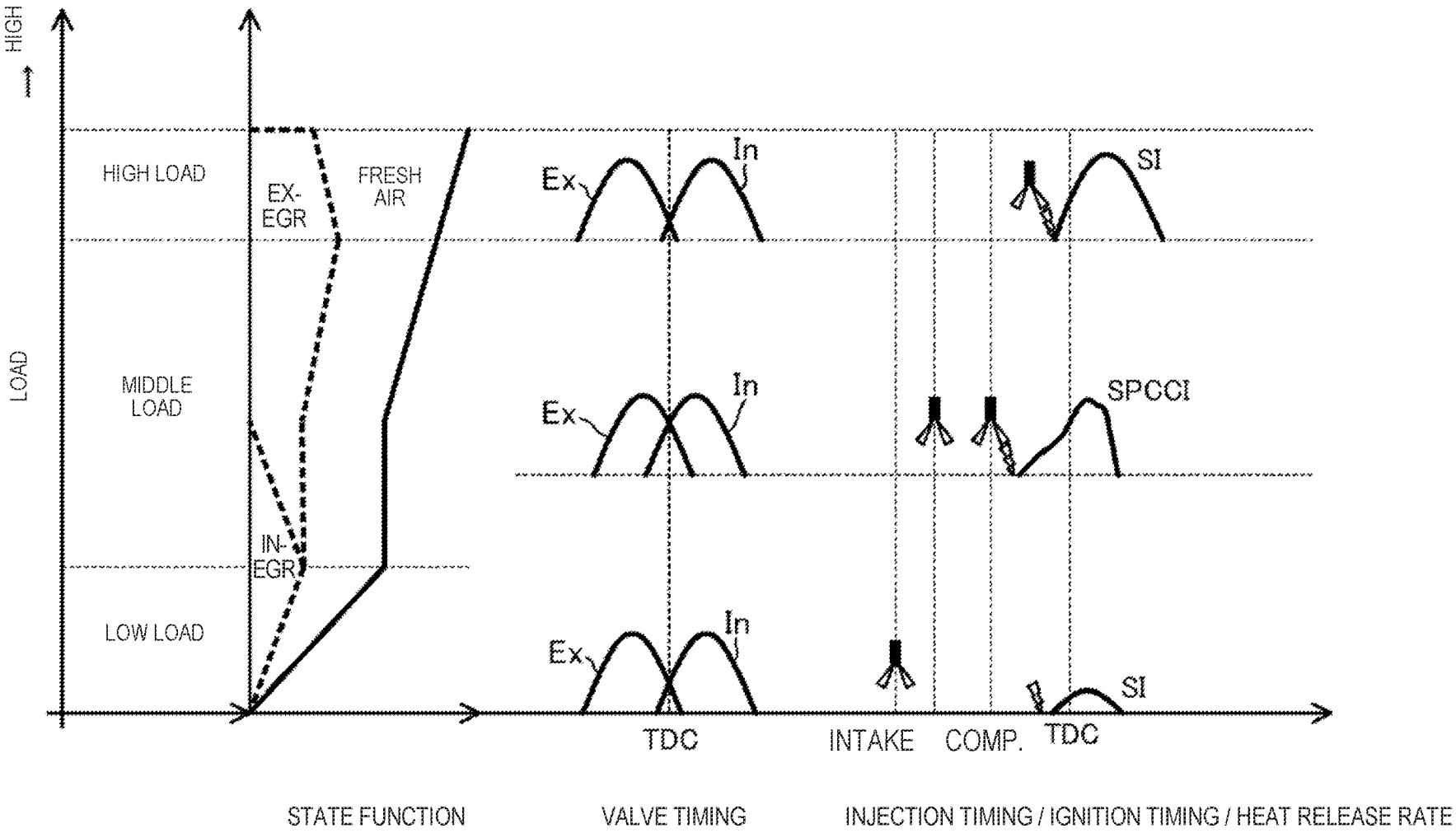
FIG. 4 is a view illustrating changes in a state function, valve timings, a fuel injection timing, an ignition timing, and a heat release rate, according to a change in a load of the internal combustion engine.

FIG. 4 is a view illustrating changes in a state function inside the cylinder 11, the valve timings of the intake valve 21 and the exhaust valve 22, the fuel injection timing, the ignition timing, and a heat release rate, according to a load of the internal combustion engine 1 (i.e., the vertical axis). FIG. 4 corresponds to a case where a speed of the engine 1 is a given fixed speed. When the speed range of the engine 1 is equally divided into three ranges (a low-speed range, a middle-speed range, and a high-speed range), the given speed corresponds to a speed in the low-speed range or the middle-speed range.

(Low-Load Range)

When an operating state of the engine 1 is in a low-load range, the engine 1 performs SI (Spark Ignition) combustion. In other words, a range where the load is a relatively low and the SI combustion is performed, is referred to as the "low-load range." The SI combustion is a combustion mode in which the mixture gas inside the cylinder 11 is ignited by the spark plug 25 to be combusted by flame propagation.

In order to improve the fuel efficiency, the engine 1 introduces EGR gas into the cylinder 11 when it operates in the low-load range. Accordingly, a heat capacity ratio of the mixture gas increases, and thus, the thermal efficiency of the engine 1 is enhanced. As a result, the fuel efficiency of the engine 1 during the operation in the low-load range is improved. An EGR ratio (i.e., a ratio of the EGR gas to the entire gas inside the cylinder 11) is set to about 40-50%.

When the operating state of the engine 1 is in the low-load range, the engine 1 introduces internal EGR gas into the cylinder 11. The internal EGR gas is introduced into the combustion chamber 17 by a valve overlap period being provided, during which both of the intake valve 21 and the exhaust valve 22 open having an exhaust top dead center (TDC) therebetween.

Figure 5:
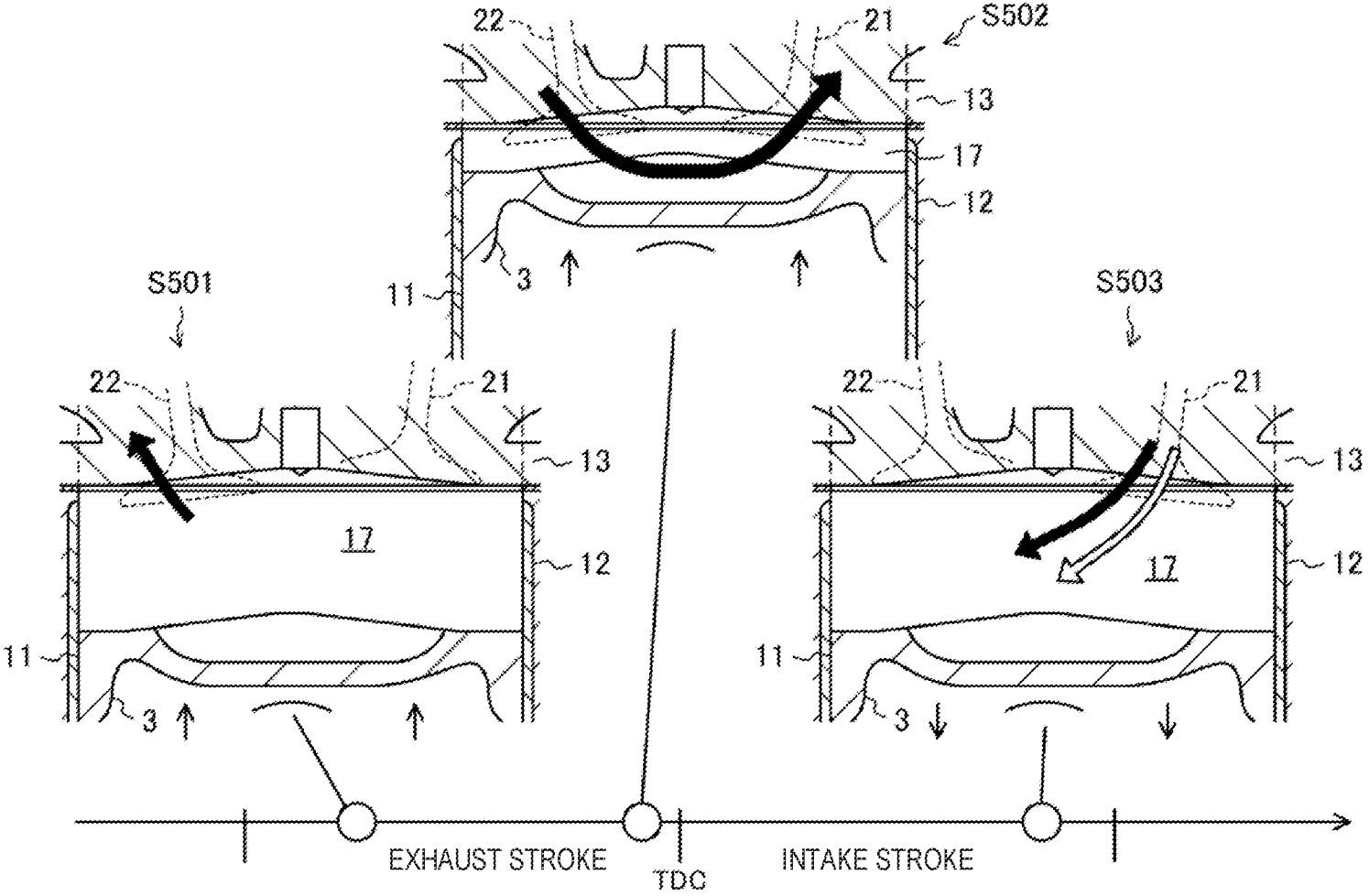
FIG. 5 is a view illustrating a flow of burnt gas inside a cylinder from an exhaust stroke to an intake stroke.

Here, FIG. 5 illustrates a flow of burnt gas inside the cylinder 11 during a period from an exhaust stroke to an intake stroke. First, as illustrated in S501, since the exhaust valve 22 opens during the exhaust stroke, the burnt gas inside the cylinder 11 is discharged to the exhaust port 19 and the exhaust passage 50 (see a black arrow in the figure). Here, the intake valve 21 is closed.

When a cycle of the engine 1 approaches the exhaust TDC, as illustrated in S502, the intake valve 21 opens. When the intake valve 21 opens, a part of the burnt gas flows from the independent exhaust passage 501 side to the independent intake passage 401 side (see a black arrow in the figure) due to a differential pressure between the pressure on the independent exhaust passage 501 side and the pressure on the independent intake passage 401 side. That is, during the overlap period, a part of the burnt gas flows from the independent exhaust passage 501 side to the independent intake passage 401 side.

Then, as the cycle of the engine 1 exceeds the exhaust TDC and the piston 3 starts descending, and the exhaust valve 22 closes, as illustrated in S503, fresh air and burnt gas are introduced into the cylinder 11 from the independent intake passage 401 and the intake port 18 (see a white arrow and a black arrow in the figure). The internal EGR gas is introduced into the cylinder 11.

An amount of internal EGR gas to be introduced into the cylinder 11 is controlled by the length of the overlap period being adjusted. The overlap period is controlled by the intake S-VT 23 adjusting the rotational phase of the intake camshaft, and the exhaust S-VT 24 adjusting the rotational phase of the exhaust camshaft. Moreover, an amount of fresh air to be introduced into the cylinder 11 is also changed by the overlap period being adjusted.

Referring again to FIG. 4, the injector 6 injects fuel into the cylinder 11, for example, during an intake stroke, and a homogeneous mixture gas containing fresh air, fuel, and EGR gas is formed inside the cylinder 11. The spark plug 25 ignites the mixture gas at a given timing before a compression TDC. The mixture gas does not self-ignite, but combusts by flame propagation.

(Middle-Load Range)

When the operating state of the engine 1 is in a middle-load range, the engine 1 performs the SPCCI (SPark Controlled Compression Ignition) combustion. In other words, a range where the SPCCI combustion is performed is referred to as the "middle-load range." The SPCCI combustion is a combustion mode combining the SI combustion and CI (Compression Ignition) combustion (or auto-ignition combustion). In the SPCCI combustion, the mixture gas inside the cylinder 11 is forcibly ignited by the spark plug 25 so as to combust by flame propagation, and unburnt mixture gas combusts by self-ignition as a result of increase in the in-cylinder temperature due to the heat release in the SI combustion. By controlling an amount of heat release in the SI combustion, variation in the in-cylinder temperature before the start of the compression can be absorbed. Even if the in-cylinder temperature before the start of the compression varies, for example, by controlling a start timing of the SI combustion by adjusting the ignition timing, the unburnt mixture gas can be caused to self-ignite at a target timing.

In order to accurately control the self-ignition timing in the SPCCI combustion, the engine 1 introduces EGR gas into the cylinder 11. The EGR ratio is set to about 40-50% at the maximum. The introduction of EGR gas into the cylinder 11 leads to higher heat capacity ratio of the mixture gas, thus being advantageous also for improving the fuel efficiency. Further, when the EGR gas is introduced into the cylinder 11, the combustion speed of the compression self-ignition combustion in the SPCCI combustion is accelerated, which is also advantageous for improving the fuel efficiency.

When the operating state of the engine 1 is in the middle-load range, the engine 1 introduces internal EGR gas into the cylinder 11. The internal EGR gas is introduced into the combustion chamber 17 by the valve overlap period being provided, during which both of the intake valve 21 and the exhaust valve 22 open having the exhaust TDC therebetween. The rotational phase of the intake camshaft and the rotational phase of the exhaust camshaft are each suitably changed according to the load of the engine 1.

Further, as the load becomes higher, the engine 1 reduces the amount of internal EGR gas and increases an amount of external EGR gas. The overlap period is made shorter while the opening of the EGR valve 54 is made larger. The in-cylinder temperature is controlled by the ratio of the internal EGR gas to the external EGR gas being adjusted.

When the engine 1 operates in the middle-load range, the injector 6 injects fuel into the combustion chamber 17 dividedly into two (early injection and latter injection). In the early injection, fuel is injected at a timing distant from the ignition timing, and in the latter injection, fuel is injected near the ignition timing. For example, the early injection is carried out within a period from an intake stroke to an early half of a compression stroke, and the latter injection is carried out within a period from a latter half of the compression stroke to an early half of an expansion stroke. The early half and the latter half of the compression stroke may be the early half and the latter half when a compression stroke is equally divided into two with respect to a crank angle. The early half of the expansion stroke may be the early half when an expansion stroke is equally divided into two with respect to a crank angle.

The spark plug 25 ignites the mixture gas at a given timing before the compression TDC. The mixture gas is combusted by flame propagation. Then, unburnt mixture gas self-ignites at a target timing to be combusted by the CI combustion. The fuel injected in the latter injection is combusted mainly by the SI combustion whereas the fuel injected in the early injection is combusted mainly by the CI combustion. Since the early injection is performed during the compression stroke, it is possible to prevent the fuel injected in the early injection from triggering abnormal combustion, such as preignition. Moreover, the fuel injected in the latter injection can stably be combusted by flame propagation.

(High-Load Range)

When the operating state of the engine 1 is in a high-load range, the engine 1 performs the SI combustion. This is a result of giving priority to avoidance of combustion noise. A range where the load is relatively high and the SI combustion is performed, is referred to as the "high-load range."

The engine 1 introduces external EGR gas into the cylinder 11. The EGR ratio decreases as the load of the engine 1 becomes higher. The amount of fresh air introduced into the cylinder 11 increases by the reduced amount of EGR gas, and thus, the amount of fuel can be increased. This is advantageous for increasing the maximum output of the engine 1.

When the engine 1 operates in the high-load range, the injector 6 injects fuel into the cylinder 11 at a timing within a period from the latter half of the compression stroke to the early half of the expansion stroke. By the injection timing of fuel being retarded, a reaction time of the mixture gas inside the cylinder 11 becomes shorter, and thus, abnormal combustion can be avoided.

After the fuel injection, the spark plug 25 ignites the mixture gas at a timing near the compression TDC. The mixture gas is combusted by the SI combustion.

(Lift Characteristics of Intake Valve and Exhaust Valve)

As described above, when the load is low, the engine 1 introduces internal EGR gas into the cylinder 11 to improve the fuel efficiency. In order to introduce a large amount of internal EGR gas into the cylinder 11, the overlap period during which both of the exhaust valve 22 and the intake valve 21 open may be made longer. By setting the rotational phase of the exhaust camshaft to the most retarded angle, and setting the rotational phase of the intake camshaft to the most advanced angle, the overlap period becomes longer, which increases the amount of internal EGR gas introduced into the cylinder 11.

On the other hand, as the load of the engine 1 becomes higher, the demanded amount of fresh air also increases, and thus, both of internal EGR gas and fresh air are required to be introduced into the cylinder 11 by a large amount. However, when the opening of the throttle valve 43 is increased accompanying with the increase in the demanded amount of fresh air, the pressure in the independent intake passage 401 rises, thus the differential pressure between the independent exhaust passage 501 side and the independent intake passage 401 side being reduced. This is disadvantageous for blowing back burnt gas from the independent exhaust passage 501 side to the independent intake passage 401 side during the overlap period. Since the engine 1 is a naturally aspirated engine, boosting pressure cannot be utilized to introduce fresh air into the cylinder 11.

In this respect, the lift characteristics of the intake valve 21 and the exhaust valve 22 of the engine 1 are devised so that the naturally aspirated engine can introduce both of the internal EGR gas and the fresh air into the cylinder 11 by a large amount.

Figure 6:
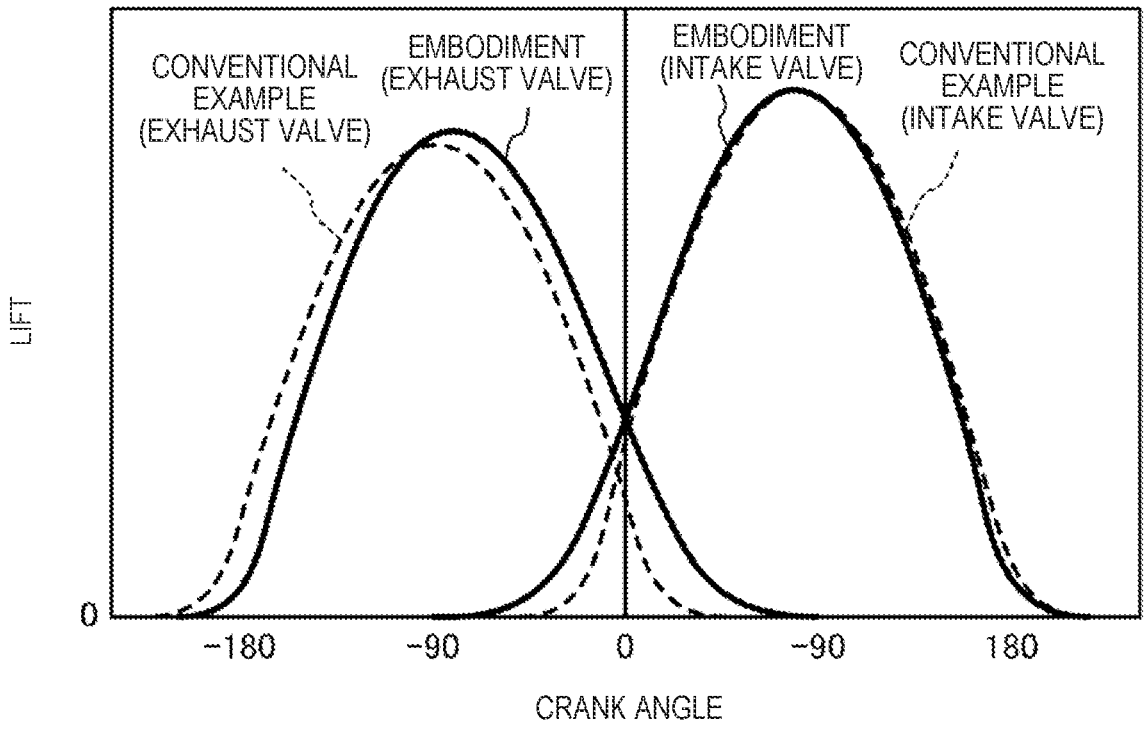
FIG. 6 is a graph illustrating lift curves of an intake valve and an exhaust valve.

FIG. 6 illustrates lift curves of the intake valve 21 and the exhaust valve 22. First, as a lift characteristic of the intake valve 21, the open period of the intake valve 21 from an open timing to a close timing is set to be a long period. In detail, an intake cam lobe of the intake camshaft is configured such that the open period of the intake valve 21 is 210° or larger and 330° or smaller of the crank angle. In this embodiment indicated by a solid line in FIG. 6, the open period of the intake valve 21 is 270° of the crank angle. In a conventional example indicated by a broken line, the open period of the intake valve is shorter than that of this embodiment. When the open period of the intake valve 21 is the long period, even if the rotational phase of the intake camshaft is advanced to the maximum, the close timing of the intake valve 21 can be set to after as well as near an intake bottom dead center (BDC). Note that FIG. 6 illustrates the open timing and the close timing of the intake valve 21 when the rotational phase of the intake camshaft is advanced to the maximum. Since the close timing of the intake valve 21 is made to be at an appropriate timing, a large amount of fresh air can be introduced into the cylinder 11.

Moreover, when the open period of the intake valve 21 is the long period, the open timing of the intake valve 21 when the rotational phase of the intake camshaft is advanced, can be advanced in an exhaust stroke. This is advantageous for introducing a large amount of internal EGR gas into the cylinder 11. In the conventional example indicated by the broken line, the open timing is relatively late.

As indicated by a solid line, a lift characteristic of the exhaust valve 22 according to this embodiment is set such that the lift amount becomes large in an early half of the overlap period. Note that a broken line indicates the conventional example. Here, as a parameter representing the lift characteristic of the exhaust valve 22, a parameter S [CA/mm] represented in the following Formula 3 is used.

$$S = \frac{\text{L_ex}}{V} \times \int_{CA_{IVO}}^{CA_{center}} \text{Lift}(CA)dCA \tag{3}$$

Figure 7:
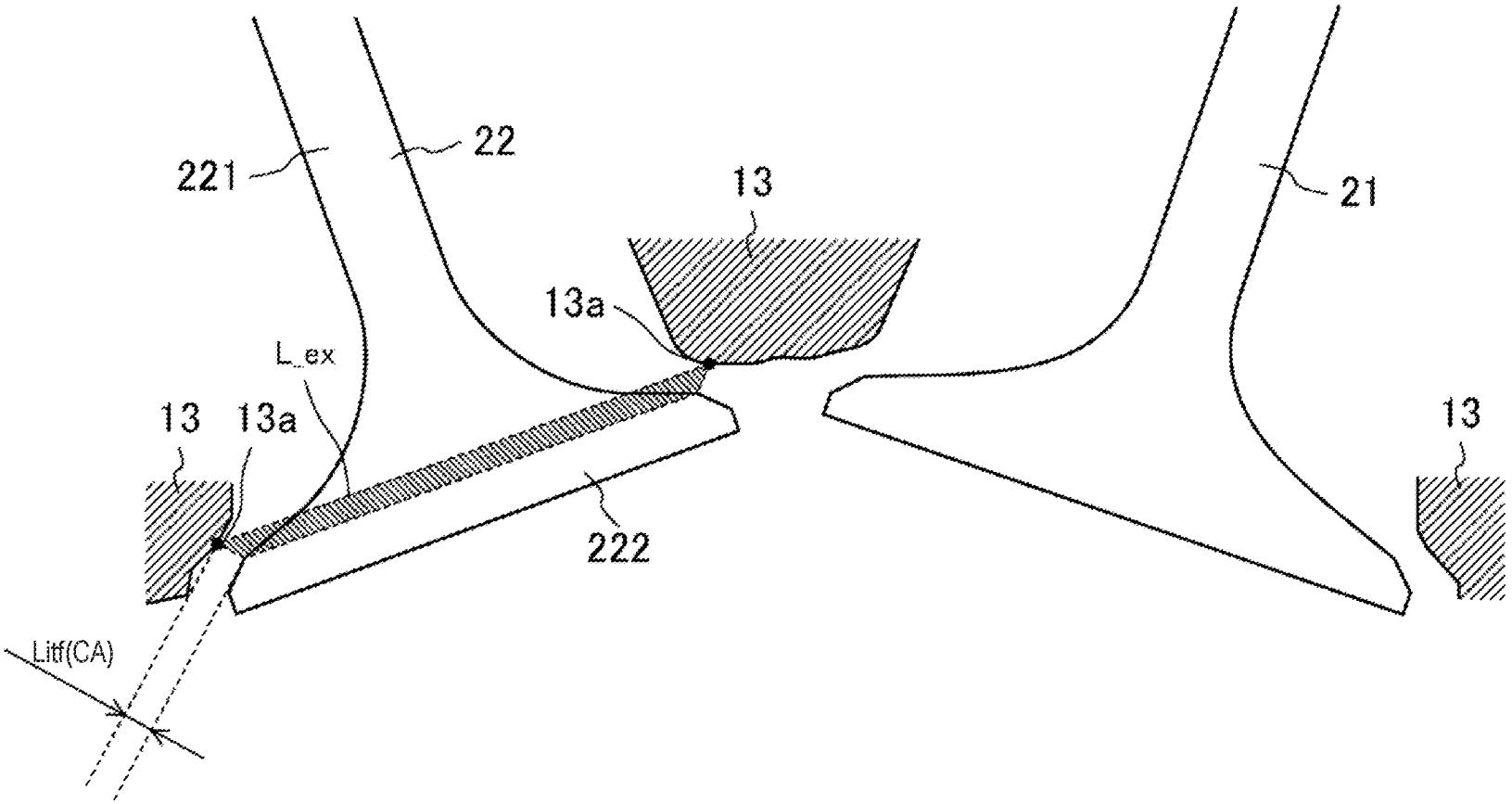
FIG. 7 is a view illustrating an effective opening area of the valve.

Here, "$CA_{IVO}$" is the open timing of the intake valve 21, and "$CA_{center}$" is a middle timing of the overlap period. Further, as illustrated in FIG. 7, "L_ex" is an inner circumferential length of a valve seat 13*a* which contacts an umbrella part 222 of the exhaust valve 22 (comprised of a stem 221 and the umbrella part 222) when the exhaust valve 22 is closed. "Lift(CA)" is an amount of effective valve lift of the exhaust valve 22. The effective valve lift amount is a distance from the valve seat 13*a* to the umbrella part 222 of the exhaust valve 22, and is a function of the crank angle. "V" is a swept volume per cylinder.

Figure 8:
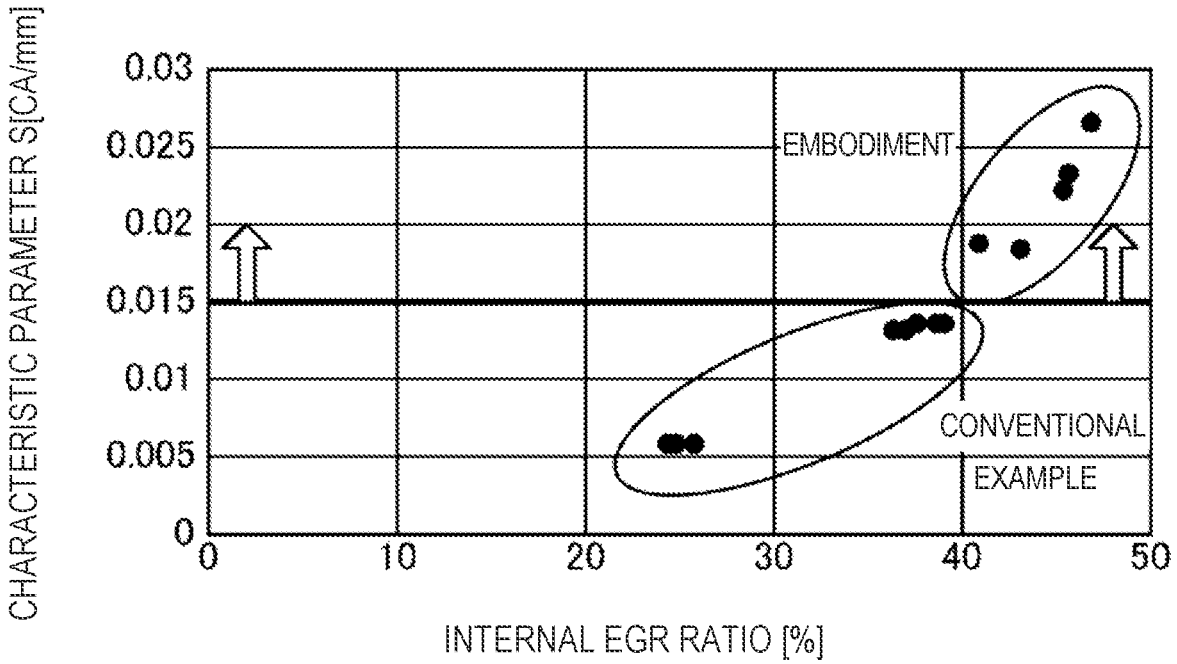
FIG. 8 is a graph illustrating a relation between an internal EGR ratio and a lift characteristic parameter of the exhaust valve.

The present inventors research a relation between the parameter S and the internal EGR ratio. FIG. 8 illustrates the relation between the parameter S and the internal EGR ratio. The internal EGR ratio is a ratio of internal EGR gas to the entire gas inside the cylinder 11. The parameter S is a value under a condition that the overlap period becomes the maximum by setting the rotational phase of the exhaust camshaft to the most retarded angle, and setting the rotational phase of the intake camshaft to the most advanced angle.

As illustrated in FIG. 8, there is a correlation between the parameter S and the internal EGR ratio, and the internal EGR ratio increases as the parameter S increases. When the internal EGR ratio at 40-50% is to be achieved as described above, the parameter S is required to be at or above 0.015 [CA/mm]. In the conventional example, the internal EGR ratio at 0-50% cannot be achieved. An exhaust cam lobe according to this embodiment is configured to satisfy the following Formula 4.

$$0.015 \leq \frac{\text{L_ex}}{V} \times \int_{CA_{IVO}}^{CA_{center}} \text{Lift}(CA)dCA \tag{4}$$

The engine 1 with the lift characteristic of the exhaust valve 22 as described above can secure a sufficient amount of internal EGR.

Therefore, by the combination of setting the open period of the intake valve 21 to be the long period, and setting the parameter S of the lift characteristic of the exhaust valve 22 at or above 0.015, the engine 1 can achieve the improvement in the fuel efficiency when the load is low, and compatibility between the fuel efficiency and the driving performance when the load is high.

Figure 9:
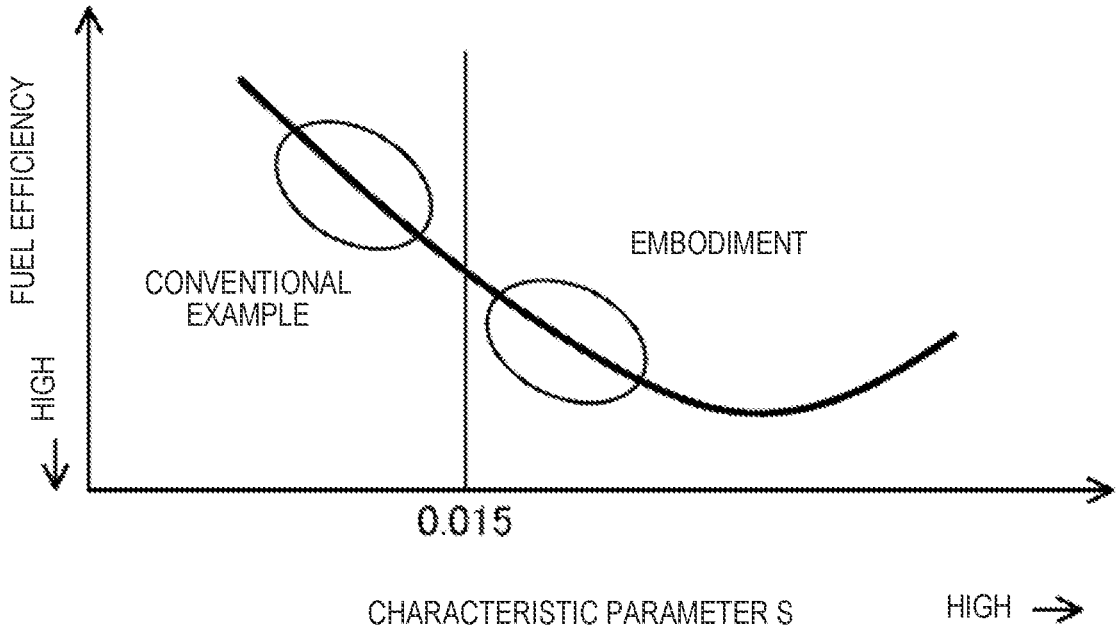
FIG. 9 is a graph illustrating a relationship between the lift characteristic parameter of the exhaust valve and the fuel efficiency.

FIG. 9 illustrates a relationship between the parameter S and the fuel efficiency of the engine 1. As illustrated in FIG. 9, the fuel efficiency improves as the parameter S increases. Compared with the internal combustion engine of the conventional example, the internal combustion engine 1 of this embodiment is improved in the fuel efficiency.

Note that the technology disclosed herein is not limited to be applied to the internal combustion engine 1 with the configuration described above. The technology disclosed herein is applicable to the internal combustion engine 1 with various configurations.

It should be understood that the embodiments herein are illustrative and not restrictive, since the scope of the invention is defined by the appended claims rather than by the description preceding them, and all changes that fall within metes and bounds of the claims, or equivalence of such metes and bounds thereof, are therefore intended to be embraced by the claims.

DESCRIPTION OF REFERENCE CHARACTERS

1 Internal Combustion Engine
10 ECU (Controller)
11 Cylinder
13 Cylinder Head
15 Crankshaft

17 Combustion Chamber
21 Intake Valve
22 Exhaust Valve
25 Spark Plug
3 Piston
401 Independent Intake Passage
501 Independent Exhaust Passage
6 Injector

What is claimed is:

1. An internal combustion engine provided with a plurality of cylinders, an intake valve and an exhaust valve provided to each of the cylinders, an independent intake passage communicating at a downstream end thereof with each of the cylinders through the respective intake valve, and an independent exhaust passage communicating at an upstream end thereof with each of the cylinders through the respective exhaust valve, the engine comprising:

an intake camshaft including intake cam lobes configured to reciprocatably move the intake valves to have a given lift characteristic, respectively, and mechanically connected to the intake valves;

an exhaust camshaft including exhaust cam lobes configured to reciprocatably move the exhaust valves to have a given lift characteristic, respectively, and mechanically connected to the exhaust valves; and a variable phase mechanism configured to change rotational phases of the intake camshaft and the exhaust camshaft with respect to a crankshaft, respectively, so that a valve overlap during which both of the intake valve and the exhaust valve of the same cylinder are open is made, wherein the intake cam lobes are formed such that an open period of each intake valve from an open timing to a close timing is 210° or larger and 330° or smaller of a crank angle, and wherein the exhaust cam lobes are formed such that, for each cylinder, during the overlap period when the variable phase mechanism advances the rotational phase of the intake camshaft to the maximum, and retards the rotational phase of the exhaust camshaft to the maximum, an amount of effective valve lift (Lift (CA)) of the exhaust valve, an inner circumferential length (L_ex) of a valve seat that contacts the exhaust valve when the exhaust valve is closed, and a swept volume (V) per cylinder satisfy the following formula, the amount of effective valve lift being a function of a crank angle from the open timing ($CA_{IVO}$) of the intake valve to a middle timing ($CA_{center}$) of the overlap period:

$$0.015 \leq \frac{L_ex}{V} \times \int_{CA_{IVO}}^{CA_{center}} \mathrm{Lift}(CA)dCA.$$

2. The engine of claim 1, further comprising:

an injector configured to inject fuel into each of the cylinders;

a spark plug configured to ignite a mixture gas containing fuel, air, and exhaust gas recirculation (EGR) gas inside each of the cylinders; and a controller electrically connected to the injector and the spark plug, and configured to control the injector and the spark plug by sending an electric signal, wherein the controller controls the injector and the spark plug so that, at least within part of an operation range of the engine, the mixture gas is ignited to start flame propagation combustion, and then unburned mixture gas is compressed to self-ignite.

3. The engine of claim 2, wherein a compression ratio of a combustion chamber, comprised of a crown surface of a piston accommodated in the cylinder and a lower surface of a cylinder head, is above 14.0:1.

4. The engine of claim 3, wherein the engine is a naturally aspirated engine.

5. The engine of claim 4, wherein the engine is a six-cylinder engine with a total displacement at 2.9 L or larger, and is disposed longitudinally in a vehicle.

6. The engine of claim 1, wherein a compression ratio of a combustion chamber comprised of a crown surface of a piston accommodated in the cylinder, and a lower surface of a cylinder head is above 14.0:1.

7. The engine of claim 1, wherein the engine is a naturally aspirated engine.

8. The engine of claim 1, wherein the engine is a six-cylinder engine with a total displacement at 2.9 L or larger, and is disposed longitudinally in a vehicle.

9. The engine of claim 2, wherein the engine is a naturally aspirated engine.

10. The engine of claim 2, wherein the engine is a six-cylinder engine with a total displacement at 2.9 L or larger, and is disposed longitudinally in a vehicle.

11. The engine of claim 3, wherein the engine is a six-cylinder engine with a total displacement at 2.9 L or larger, and is disposed longitudinally in a vehicle.

12. The engine of claim 6, wherein the engine is a naturally aspirated engine.

13. The engine of claim 6, wherein the engine is a six-cylinder engine with a total displacement at 2.9 L or larger, and is disposed longitudinally in a vehicle.

14. The engine of claim 7, wherein the engine is a six-cylinder engine with a total displacement at 2.9 L or larger, and is disposed longitudinally in a vehicle.

15. The engine of claim 9, wherein the engine is a six-cylinder engine with a total displacement at 2.9 L or larger, and is disposed longitudinally in a vehicle.

16. The engine of claim 12, wherein the engine is a six-cylinder engine with a total displacement at 2.9 L or larger, and is disposed longitudinally in a vehicle.

17. The engine of claim 2, further comprising a water-cooled type EGR cooler and an EGR valve disposed in an EGR passage, wherein the controller controls the EGR valve to adjust a flow rate of exhaust gas passing through the EGR passage, and wherein, when the engine operates at a given fixed speed, an amount of internal EGR gas is increased as a load of the engine increases from low to middle, and the amount of internal EGR gas is reduced while an amount of external EGR gas is increased when the load is middle, the given fixed speed being a low-speed range or a middle-speed range when the speed of the engine is divided equally into three ranges including the low-speed range, the middle-speed range, and a high-speed range.

18. The engine of claim 6, further comprising:

a water-cooled type EGR cooler;

an EGR valve disposed in an EGR passage; and a controller configured to control the EGR valve to adjust a flow rate of exhaust gas passing through the EGR passage, wherein, when the engine operates at a given fixed speed, an amount of internal EGR gas is increased as a load of the engine increases from low to middle, and the amount of internal EGR gas is reduced while an amount of external EGR gas is increased when the load is middle, the given fixed speed being a low-speed range or a middle-speed range when the speed of the engine is divided equally into three ranges including the low-speed range, the middle-speed range, and a high-speed range.

19. The engine of claim 7, further comprising:

a water-cooled type EGR cooler;

an EGR valve disposed in an EGR passage; and a controller configured to control the EGR valve to adjust a flow rate of exhaust gas passing through the EGR passage, wherein, when the engine operates at a given fixed speed, an amount of internal EGR gas is increased as a load of the engine increases from low to middle, and the amount of internal EGR gas is reduced while an amount of external EGR gas is increased when the load is middle, the given fixed speed being a low-speed range or a middle-speed range when the speed of the engine is divided equally into three ranges including the low-speed range, the middle-speed range, and a high-speed range.

20. The engine of claim 8, further comprising:

a water-cooled type EGR cooler;

an EGR valve disposed in an EGR passage; and a controller configured to control the EGR valve to adjust a flow rate of exhaust gas passing through the EGR passage, wherein, when the engine operates at a given fixed speed, an amount of internal EGR gas is increased as a load of the engine increases from low to middle, and the amount of internal EGR gas is reduced while an amount of external EGR gas is increased when the load is middle, the given fixed speed being a low-speed range or a middle-speed range when the speed of the engine is divided equally into three ranges including the low-speed range, the middle-speed range, and a high-speed range.

* * * * *